US006571910B2

(12) United States Patent
Storm

(10) Patent No.: US 6,571,910 B2
(45) Date of Patent: Jun. 3, 2003

(54) METHOD AND APPARATUS FOR IMPROVED NOISE ATTENUATION IN A DISSIPATIVE INTERNAL COMBUSTION ENGINE EXHAUST MUFFLER

(75) Inventor: Mark Storm, Phoenix, AZ (US)

(73) Assignee: Quiet Storm, LLC, Phoenix, AZ (US)

( * ) Notice: Subject to any disclaimer, the term of this patent is extended or adjusted under 35 U.S.C. 154(b) by 0 days.

(21) Appl. No.: 10/029,340

(22) Filed: Dec. 20, 2001

(65) Prior Publication Data

US 2002/0121404 A1 Sep. 5, 2002

Related U.S. Application Data

(60) Provisional application No. 60/257,018, filed on Dec. 20, 2000.

(51) Int. Cl.[7] ..... F01N 7/16; F01N 1/12

(52) U.S. Cl. ..... 181/264; 181/280; 181/249; 181/268

(58) Field of Search ..... 181/247, 249, 181/252, 256, 264, 280, 212, 268

(56) References Cited

U.S. PATENT DOCUMENTS

| | | | | |
|---|---|---|---|---|
| 1,236,987 | A | 8/1917 | Schmitt | |
| 1,317,858 | A | 10/1919 | Brown | |
| 1,700,993 | A | 2/1929 | Bernet et al. | |
| 1,772,589 | A | 8/1930 | Beamer | |
| 1,848,990 | A | 3/1932 | Boyd et al. | |
| 2,485,555 | A | 10/1949 | Bester | 181/49 |
| 2,707,525 | A | 5/1955 | Janeway | 181/56 |
| 2,971,599 | A | 2/1961 | Tobias | 181/53 |
| 3,135,350 | A | 6/1964 | Mattie | 181/56 |
| 3,504,516 | A | 4/1970 | Sundberg | 72/203 |
| 3,505,038 | A | 4/1970 | Luksch et al. | 29/183.5 |
| 3,590,947 | A | 7/1971 | Latch et al. | 181/53 |
| 3,685,614 | A | 8/1972 | Coanda et al. | 181/33 E |
| 3,688,870 | A | 9/1972 | Gibel | 181/55 |
| 3,704,763 | A | 12/1972 | Becker et al. | 181/47 B |
| 3,786,896 | A | 1/1974 | Foster et al. | 181/53 |
| 3,786,897 | A | 1/1974 | Swanson | 181/54 |
| 3,802,163 | A | 4/1974 | Riojas | 55/276 |
| 3,827,531 | A | 8/1974 | Hansen | 181/53 |
| 3,897,852 | A | 8/1975 | Hoffman et al. | 181/45 |
| 3,897,854 | A | 8/1975 | Rhodes | 181/64 A |
| 3,920,095 | A | 11/1975 | Clark | 181/42 |
| 3,948,439 | A | 4/1976 | Heeger | 236/21 B |
| 3,955,643 | A | 5/1976 | Clark | 181/42 |
| 3,997,002 | A | 12/1976 | Baker et al. | 165/154 |

(List continued on next page.)

OTHER PUBLICATIONS

Schultz, Theodore J., "Acoustical Uses for Perforated Metals: Principles and Applications" (Industrial Perforators Association, Inc., published 1986).*

*Primary Examiner*—Robert E. Nappi
*Assistant Examiner*—David Warren
(74) *Attorney, Agent, or Firm*—Rod D. Baker; Peacock, Myers & Adams, PC

(57) ABSTRACT

The use of fiber metal or similarly high flow resistance and high acoustic transparency material as a liner for traditional acoustically absorptive media in a dissipative muffler exhibits improved low frequency sound attenuation, reduces backpressure, and eliminates media entrainment or "blow-out" phenomenon which results in longer muffler life. The same class of materials may also be used to fashion an element that provides linear occlusion inside an otherwise line-of-sight type of muffler, where the occluding element provides improved impedance-matching acoustic absorption. Disclosed embodiments providing linear occlusion minimize traditional increases in muffler backpressure by incorporating helical, conical, and annular members in mufflers with round ducts. To maximize attenuation, a muffler according to the invention may feature both a fiber metal fill liner and a fiber metal linear occlusion element. Further, the liner that connects the inlet and outlet ports of the muffler may feature an offset, elbow, or turn that would simultaneously allow it to provide means for linear occlusion.

22 Claims, 5 Drawing Sheets

U.S. PATENT DOCUMENTS 4,006,793 A 2/1977 Robinson ..... 181/53
4,022,291 A 5/1977 Stephenson ..... 181/53
4,090,583 A 5/1978 Leonard ..... 181/240
4,094,644 A 6/1978 Wagner ..... 23/288 F
4,113,051 A 9/1978 Moller ..... 181/231
4,116,303 A 9/1978 Trudell ..... 181/252
4,119,174 A 10/1978 Hoffman ..... 181/231
4,161,996 A 7/1979 Dolejsi ..... 181/230
4,164,267 A 8/1979 Meineke et al. ..... 181/255
4,184,565 A 1/1980 Price et al. ..... 181/252
4,263,981 A 4/1981 Weiss et al. ..... 181/252
4,279,326 A 7/1981 Meineke et al. ..... 181/228
4,296,832 A 10/1981 Kicinski ..... 181/255
4,317,502 A 3/1982 Harris et al. ..... 181/280
4,332,307 A 6/1982 Ito ..... 181/256
4,359,134 A 11/1982 Jackson ..... 181/230
4,361,206 A 11/1982 Tsai ..... 181/255
4,371,054 A 2/1983 Wirt ..... 181/252
4,387,915 A 6/1983 Adickes ..... 285/330
4,393,652 A 7/1983 Munro ..... 60/295
4,408,679 A 10/1983 Littrell ..... 181/243
4,413,705 A 11/1983 Inaga et al. ..... 181/240
4,421,202 A 12/1983 Hoy ..... 181/252
4,426,844 A 1/1984 Nakano ..... 60/295
4,467,887 A 8/1984 Vizard ..... 181/265
4,482,028 A 11/1984 Fukuoka et al. ..... 181/240
4,485,890 A 12/1984 Harris et al. ..... 181/280
4,487,290 A 12/1984 Flaherty ..... 181/256
4,533,015 A 8/1985 Kojima ..... 181/280
4,541,240 A 9/1985 Munro ..... 60/295
4,570,322 A 2/1986 Dence ..... 29/402.17
4,572,327 A 2/1986 Dean ..... 181/295
4,574,914 A 3/1986 Flugger ..... 181/268
4,577,724 A 3/1986 Vizard ..... 181/265
4,628,004 A 12/1986 Nickola et al. ..... 428/413
4,645,032 A 2/1987 Ross et al. ..... 181/250
4,667,770 A 5/1987 Devane ..... 181/280
4,673,052 A 6/1987 Shinozake et al. ..... 180/219
4,690,245 A 9/1987 Gregorich et al. ..... 181/272
4,693,338 A 9/1987 Clerc ..... 181/231
4,712,643 A 12/1987 Iles et al. ..... 181/231
4,735,283 A 4/1988 Macaluso ..... 181/265
4,747,467 A 5/1988 Lyon et al. ..... 181/218
4,749,058 A 6/1988 Trainor ..... 181/239
4,756,230 A 7/1988 Shew ..... 91/55
4,760,894 A 8/1988 Harwood et al. ..... 181/282
4,786,265 A 11/1988 Porter ..... 440/89
4,809,812 A 3/1989 Flugger ..... 181/268
4,821,840 A 4/1989 Harwood et al. ..... 181/282
4,842,096 A 6/1989 Fujitsubo ..... 181/252
4,854,417 A 8/1989 Uesugi et al. ..... 181/272
4,858,722 A 8/1989 Abbe et al. ..... 181/243
4,880,078 A 11/1989 Inoue et al. ..... 181/232
4,892,168 A 1/1990 Sasaki et al. ..... 181/250
4,901,816 A 2/1990 Garey ..... 181/296
4,905,791 A 3/1990 Garey ..... 181/282
4,949,807 A 8/1990 Hirata et al. ..... 181/240
5,076,393 A 12/1991 Howerton et al. ..... 181/264
5,117,939 A 6/1992 Noguchi et al. ..... 181/224
5,139,107 A 8/1992 Nagai ..... 181/240
5,152,366 A 10/1992 Reitz ..... 181/249
5,162,620 A 11/1992 Ross et al. ..... 181/220
5,198,625 A 3/1993 Borla ..... 181/248
5,220,137 A 6/1993 Howerton et al. ..... 181/264
5,227,593 A 7/1993 Takahashi et al. ..... 181/255
5,246,473 A 9/1993 Harris ..... 55/276
5,272,286 A 12/1993 Cain et al. ..... 181/206
5,326,943 A 7/1994 Macaulay ..... 181/269
5,340,952 A 8/1994 Takiguchi ..... 181/282
5,350,088 A 9/1994 Sager, Jr. et al. ..... 181/247
5,365,025 A 11/1994 Kraai et al. ..... 181/249
5,373,119 A 12/1994 Suzuki et al. ..... 181/230
5,440,083 A 8/1995 Masuda ..... 181/240
5,443,371 A 8/1995 Calciolari ..... 417/312
5,444,197 A 8/1995 Flugger ..... 181/264
5,571,242 A 11/1996 Demorest ..... 123/184.21
5,611,409 A 3/1997 Arseneau ..... 181/228
5,651,249 A 7/1997 Nagao et al. ..... 60/302
5,659,158 A 8/1997 Browning et al. ..... 181/268
5,663,535 A 9/1997 MacDonald et al. ..... 181/224
5,731,557 A 3/1998 Norres et al. ..... 181/233
5,739,484 A 4/1998 Jones ..... 181/264
5,739,485 A 4/1998 Cholet et al. ..... 181/282
5,760,348 A 6/1998 Heuser ..... 181/272
5,773,770 A 6/1998 Jones ..... 181/268
5,801,344 A 9/1998 Herold ..... 181/272
5,808,245 A 9/1998 Wiese et al. ..... 181/255
5,824,972 A 10/1998 Butler ..... 181/279
5,831,223 A 11/1998 Kesselring ..... 181/227
5,869,793 A 2/1999 Berger et al. ..... 181/256
5,898,140 A 4/1999 Asao et al. ..... 181/272
5,912,441 A 6/1999 Worner ..... 181/282
5,952,623 A 9/1999 Sterling ..... 181/230
6,089,347 A 7/2000 Flugger ..... 181/264
6,322,133 B1 * 11/2001 Yantek et al. ..... 296/190.03

* cited by examiner

METHOD AND APPARATUS FOR IMPROVED NOISE ATTENUATION IN A DISSIPATIVE INTERNAL COMBUSTION ENGINE EXHAUST MUFFLER

CROSS-REFERENCE TO RELATED APPLICATIONS

This application claims the benefit of the filing of U.S. Provisional patent application Ser. No. 60/257,018, entitled Sound Attenuator for Four Stroke Internal Combustion Engine Exhaust, filed on Dec. 20, 2000, and the entire specification thereof is incorporated herein by reference.

BACKGROUND OF THE INVENTION

1. Field of the Invention (Technical Field)

The present invention relates generally to internal combustion engine (ICE) exhaust noise mufflers, specifically a dissipative muffler with improved maintenance, noise attenuation, durability features and reduced impact on engine efficiency.

2. Background Art

Prior art shows dissipative mufflers, which are commonly composed of an inlet port fluidically connected to an outlet port by a duct that also forms the inner wall of an annular chamber containing acoustically absorptive fill. Currently, dissipative mufflers often use a perforated metal liner defining a duct that provides a boundary between the flow of gas and the surrounding volume of acoustically absorbent fill. In typical mufflers, the absorbent fill initially is contained between the inner duct and an outer casing. In some mufflers, a perforated metal duct serves as a backing or facing for a liner made from another material, e.g., fiberglass cloth.

Some muffler apparatuses known in the art include those disclosed in the following U.S. Pat. Nos.:

| | | | | | |
|---|---|---|---|---|---|
| 4,786,256; | 3,827,531; | 5,565,124; | 5,611,409; | 4,570,322; | 5,139,107; |
| 4,905,791; | 4,880,078; | 5,912,441; | 5,831,223; | 5,773,770; | 5,739,485; |
| 5,739,484; | 5,440,083; | 5,340,952; | 5,246,473; | 4,901,816; | 4,760,894; |
| 4,712,643; | 4,693,338; | 4,577,724; | 4,467,887; | 4,413,705; | 4,332,307; |
| 4,317,502; | 4,296,832. | | | | |

Also, U.S. Pat. No. 5,162,620 to Ross provides particularly helpful background to the present invention.

According to Schultz, perforated metal has a "self flow resistance" (Schultz, *Acoustical Uses For Perforated Metals*, p. 56) and a "transparency index" (Schultz, p. 14) which can be calculated from the following:

Self Flow Resistance$=R_{self}=R_0+2\Delta R_0$; where $R_0$ is the greater of where $R_{01}=4.24(b^2t/d^3)f^{0.5}$ and $R_{02}=2.88(b^2t/d^4)$ and $2\Delta R_0=4.19(b^2/d^2)f^{0.5}\times10^{-3}$ cgs rayls.

Also,

Transparency Index$=TI=(nd^2/ta^2)=0.04P/(3.14ta^2)$

With the above variables defined as follows:

a=shortest distance between holes (a=b−d)

b=on-center hole spacing d=perforation diameter f=frequency n=number of perforations per unit area P=percentage open area t=thickness of sheet Thus, muffler ducts fashioned from ordinary perforated metal are considered reasonably "transparent" to sound; but, due to their modest flow resistance, they also permit diversion of conveyed gas flow into the chamber containing the acoustically absorbent media. Not only does this diversion create turbulence and static pressure loss, it can actually entrain or "blow out" fill media through the perforations and through unsealed muffler casing-to-endcap connections. This "blow out" problem is commonly encountered and well-known by users of conventional dissipative mufflers.

Ingard, (*Sound Absorption Technology,* 1994, p. 4–25) shows the normalized flow resistance of most perforated metals, i.e., the ratio of the flow resistance of the perforated metal sheet over the acoustical impedance of the gas flow, is near zero for most internal combustion (ICE) muffler applications and thus, when studied in combination with the fill it is lining, is excellent for preserving virtually ideal acoustical absorption at mid to high frequencies. However, effective absorption coefficient drops dramatically in the low frequency end of the overall spectrum, with absorption worsening with increasing wavelength. The resulting poor low frequency attenuation plagues all dissipative prior art designs utilizing perforated metal as a fill liner.

Thus, for ICE and other gas flow applications that have significant low frequency sound characteristics, reactive-type mufflers incorporating single or multiple chambers and tuned Helmholz resonators are usually preferred over dissipative muffler designs when low frequency noise reduction is a primary objective. Reactive mufflers, because they do not contain acoustically absorptive fill in their design, are also perceived as offering "consistent" performance—i.e., they don't degrade or "blow out," and require frequent replacement or re-packing of dissipative media like fiberglass fill. In today's marketplace, dissipative mufflers are usually regarded as "race pipes" that have far less backpressure than tortuous path reactive muffler designs, and thus have a reduced adverse impact upon engine horsepower, but at the expense of less low frequency noise reduction. In many instances, these "glass-packs" are desired for that purpose, and are installed to preserve deep and powerful-sounding low frequency engine exhaust tones.

When broad-band acoustic attenuation is required, a muffler can feature both reactive and dissipative elements either in series or parallel, with performance anticipated much in the same way one would design an electrical circuit. Such mufflers, however, can become quite complicated and heavy, as certain portions contain fill, while other portions have solid partitions. Additionally, due to the reliance on reactive methods for low frequency attenuation, even the combination muffler designs suffer high pressure losses and reduce the engine's overall performance.

Another sound attenuation technique known in the art, primarily for aerospace and industrial applications, is the use of components crafted from fibrous sintered metal (a.k.a. fiber metal) as a high flow resistance facing for empty cavities that resemble Helmholz resonators. The understood purpose of the cavity is to provide, like a Helmholz resonator, a quarter-wavelength distance which enables the facing material to intercept specific waveforms at their maximum amplitudes and thus yield highest attenuation for a narrow band of frequencies. The published literature (Clark, "Turning Down the Volume", *Machine Design,* Sep. 24, 1993) summarizes the function of the fiber metal as an alternative form of dissipative attenuation which can replace traditional fill. Sales collateral from one manufacturer of fiber metal carries this theme further by noting disadvantages of fiberglass media when compared to the fiber metal faced cavity attenuation technique. Nowhere is suggestion made, however, that the cavities might be occupied with acoustically absorbent fill, or that the fiber metal element serves only as a liner or container for another material.

Two of Clark's U.S. Pat. Nos., 3,955,643 and 3,920,095, reiterate the use of fiber metal as a facing for empty Helmholz-like cavities. In the former, fiber metal is used in conjunction with other flow-resistive materials to furnish a cavity liner with "continually increasing" flow resistance. In the latter, fiber metal faced cavities are part of a combination muffler device designed to produce low and high frequency attenuation.

Yet another technique for improving sound attenuation in a muffler is to use linear occlusion of the gas flow path. In such a technique, what would otherwise be a clear line-of-sight between the inlet and outlet ports of a muffling device is blocked or obscured by obstructions, offsets, turns, or some other means. Prior art shows many ways linear occlusion can be provided, as exhibited by the following reference list of U.S. Pat. Nos.:

2,707,525; 1,236,987; 6,089,347; 5,824,972; 5,444,197; 4,809,812; 4,735,283; 3,590,947; 2,971,599; 1,772,589.

But while such means for linear occlusion may provide desirable improvements in sound reduction, there is usually a dramatic performance cost manifested by increased back-pressure in the muffler. Therefore, it may be desirable to implement the least flow resistive means of linear occlusion while gaining as much noise attenuation as possible. For example, as some of the above references disclose, helical or spiral flow passages avoid the use of highly restrictive ninety-degree or reverse-turning elbows, yet still provide linear occlusion. A study of the prior art featuring such flow passage geometries resulted in the following findings: Itani (U.S. Pat. No. 4,635,753) suggests a dissipative muffler design with coaxial spiraling polygonal ducts. Taniguchi (U.S. Pat. No. 4,303,143) demonstrates spiraling blades. Fisher (U.S. Pat. No. 1,341,976) utilizes a solid-looking helical member, with or without varying pitch, inside a close-fitting casing. Flint (U.S. Pat. No. 2,482,754) also uses a solid helical twist of sheet metal, and specifies the length must be ten times the diameter. Smith (U.S. Pat. No. 3,235,003) calls for spiral plates that may be solid or perforated. DeVane (U.S. Pat. No. 3,696,883) describes a helical-shaped baffle assembly which makes use of bars and spokes for internal support and attachment to the surrounding flow duct. De Cardenas (U.S. Pat. No. 3,746,126) suggests a flat bar twisted into a helix, with pitch equal to half the diameter. DeVane (U.S. Pat. No. 4,667,770) requires a tubular frame and other parts comprising yet another helical embodiment of linear occlusion. Kojima (U.S. Pat. No. 4,533,015) shows a plurality of helical members arranged sequentially inside a flow duct. Bokor (U.S. Pat. No. 6,089,348) makes use of a spiral vane in the reactive section of a series combination muffler design. Johnston (U.S. Pat. No. 6,167,699) incorporates half-twist helical strips inside specific pipe sections of a larger assembly. Calciolari (U.S. Pat. No. 5,443,371) utilizes a helical insert to help reduce compressor noise.

While the prior art perhaps suggests the function of, for instance, a linearly occluding helical insert in its capacity to scatter, deflect, or otherwise affect sound waves traversing the muffler duct, to the inventor's knowledge nothing in the known art calls for use of an impedance-matching material as a means of linear occlusion.

SUMMARY OF THE INVENTION (DISCLOSURE OF THE INVENTION)

The invention is an apparatus and method for improved sound attenuation in mufflers, especially mufflers for internal combustion engines. The use of fiber metal or similarly high flow resistance and high acoustic transparency material as a liner for traditional acoustically absorptive media in a dissipative muffler exhibits improved low frequency sound attenuation, reduces backpressure, and eliminates media entrainment or "blow-out" phenomenon which results in longer muffler life. The same class of materials may also be used to fashion an element that provides linear occlusion inside an otherwise line-of-sight type of muffler, where the occluding element provides improved impedance-matching acoustic absorption. Disclosed embodiments providing linear occlusion minimize traditional increases in muffler back-pressure by incorporating helical, conical, and annular members in mufflers with round ducts. To maximize attenuation, a muffler according to the invention may feature both a fiber metal fill liner and a fiber metal linear occlusion element. Further, the liner that connects the inlet and outlet ports of the muffler may feature an offset, elbow, or turn that would simultaneously allow it to provide means for linear occlusion.

There is provided according to the invention a sound attenuating apparatus for conveying internal combustion engine exhaust gases, the gases having an acoustical impedance, the apparatus comprising an inlet port and an outlet port, a rigid duct fluidically connecting said ports, said duct having a flow resistance and defining an inner wall of a chamber, and means for acoustic absorption disposed in said chamber, wherein said duct has a transparency index greater than 100,000 as calculated from Schultz's formula, and further wherein the ratio of the flow resistance of said duct to the acoustic impedance of said exhaust gases is between approximately 0.2 and approximately 2.0. The duct may be composed of a single material or a plurality of materials. In a preferred embodiment of the invention the duct provides linear occlusion between said ports.

There is also provided a sound attenuating apparatus for conveying internal combustion engine exhaust gases, the gases having an acoustic impedance, the apparatus comprising an inlet port and an outlet port fluidically connected by a rigid duct, said duct defining an inner wall of a chamber filled with means for acoustic absorption, and means for linear occlusion disposed within said duct, said linear occlusion means having a transparency index greater than about 100,000 as calculated from Schultz's formula, and said linear occlusion means also having a flow resistance, wherein the ratio of the flow resistance of said linear occlusion to the acoustic impedance of said exhaust gases results is between 0.2 and 2.0. Preferably but optionally, the means for linear occlusion is removable from within said duct.

A sound attenuating apparatus for conveying internal combustion engine exhaust gases according to the invention may also comprise an inlet port and an outlet port fluidically connected by a rigid duct, said duct having a transparency index greater than 100,000 as calculated from Schultz's formula, and also a flow resistance; and a chamber, substantially filled with means for acoustical absorption and having an inner wall defined by said duct, wherein the ratio of the flow resistance of said rigid duct over the acoustic impedance of said exhaust gases results is between 0.2 and 2.0; and means for linear occlusion disposed within said duct, said linear occlusion means having a transparency index greater than 100,000 as calculated from Schultz's formula and also a flow resistance; wherein the ratio of the flow resistance of said linear occlusion over the acoustic impedance of said exhaust gases is between 0.2 and 2.0. In one embodiment the means for linear occlusion comprises a helical member, which optionally is removable from within said duct. In the preferred embodiment of the invention, the means for linear occlusion comprises metal fiber. In the preferred embodiment of the invention, the duct also comprises metal fiber, and optionally but preferably provides linear occlusion between said inlet and outlet ports.

In one particular embodiment of the invention, a muffler has an inlet port and an outlet port fluidically connected by a rigid duct, said duct defining an inner wall of a chamber filled with means for acoustic absorption; and a helical member disposed within said duct, said member having a transparency index greater than about 100,000 as calculated from Schultz's formula, and said helical member also having a flow resistance; wherein the ratio of the flow resistance of said helical member to the acoustic impedance of said exhaust gases results is between approximately 0.2 and approximately 2.0.

A further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1A:
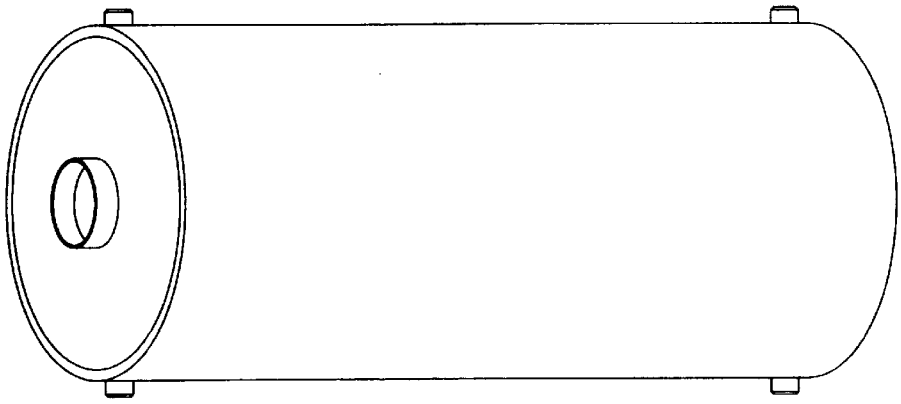
FIG. 1A PRIOR ART
FIG. 1A is an external perspective view of a conventional muffler, known in the art, with a cylindrical outer casing.

DESCRIPTION OF THE PREFERRED EMBODIMENTS (BEST MODES FOR CARRYING OUT THE INVENTION)

The present invention relates to mufflers for internal combustion engines. The invention overcomes the problems presented in conventional known mufflers through an innovative incorporation of specially configured elements, including components composed of metal fiber, or metallic felt, as described herein.

The primary function of the perforated tube duct in a conventional dissipative muffler is to convey sound waves from the exhaust flow to the surrounding annular chamber, which is filled with acoustically absorptive porous material. By acting as a liner in contact with the porous media (which shall be considered "rigid" as opposed to "flexible" since it is usually compressed between the perforated metal and the chamber wall), the perforated metal also affects the net absorption coefficient of the combination. It is known that such a combination of "resistive screen" and rigid porous media has a high absorption coefficient for mid to high frequencies (i.e., greater than 250 Hertz). It has also been determined that as the normalized flow resistance ($R/\rho c$) of the screen is increased from zero to one, absorption coefficient dramatically improves for frequencies less than 250 Hz, while the absorption coefficient for higher frequencies drops almost negligibly.

Since ICE exhaust usually has a noise spectrum with highest sound power in the low frequency range, it is desirable to attenuate this noise as much as possible. Known principles suggest that increasing the liner's normalized flow resistance would be one way to do that. However, formulae by Schultz show that this is impractical to achieve with perforated metal. In fact, a perforated metal screen would have to be nearly a half-inch in thickness and have an IPA-100 standard pattern (625 holes per square inch). Not only would such a screen be far too heavy for acceptable use by motorcycles and other vehicles, but its manufacture would be extremely difficult and expensive—if not impossible.

Fiber metal, on the other hand, provides a solution. Due to its structure of small-diameter fibers in a dense but still porous arrangement, a fiber metal screen can be easily manufactured to possess a normalized flow resistance of around 1.0 in a thin and lightweight sheet. For example, at 0.125" in thickness, the Technetics FM109® standard fiber metal sheet is only twice as thick as the commonly-used 16-gauge (0.063") perforated metal screen, but has the same mass per unit area. Therefore, in this invention fiber metal is substituted for perforated metal to improve acoustical absorption in the lower frequency range, and yield an identically-sized muffler that reduces more low-frequency noise.

Additionally, the concept of linear occlusion in the inventive muffler may be satisfied by providing a means for linear occlusion, such as a removable member or "insert" that may be disposed within the duct. Like the duct and for essentially the same reasons, the linear occlusion member preferably is fashioned form fiber metal.

This is a novel application of fiber metal as a liner or screen for acoustically-absorptive fill in a dissipative muffler. According to published materials by Technetics Company, the relationship of cavity depth, fiber metal composition, and flow properties is crucial to acoustic performance and should be heeded. For instance, the Technetics Company recommends, to obtain maximum attenuation, the cavity should be approximately one-quarter wavelength in depth. The prior art demonstrate adherence to these principles, as well as the consistently expressed purpose of fiber metal in technical and sales literature: to eliminate traditional bulk porous materials in sound attenuators. Applicants have determined otherwise, and the present invention requires fiber metal to act not as a stand-alone absorber, but rather as an acoustically-transparent liner. Further, because it is performing this new function, fiber metal is no longer constrained to the aforementioned quarter-wavelength cavity depth. As a liner, fiber metal can be applied with much greater flexibility, allowing an enormous variety of custom shapes for both the flow-facing duct and the surrounding annular chamber. Therefore, used in conjunction with common fill materials (fiberglass, steel wool, and the like), fiber metal has a new and broader application in the invention.

Additionally, because its flow resistance is higher that what can be practically achieved with perforated metals, fiber metal virtually eliminates the phenomenon of "blow-out." This advantage translates into two direct user benefits: 1) a muffler with fiber metal duct does not have to be re-packed and maintained as often—if at all; 2) muffler backpressure will not increase, which means engine horsepower can be maintained at nominal levels.

As performance enhancement is a highly sought after objective in the realm of recreational and competitive vehicular sports such as motorcycles, the invention is another approach for using fiber metal. Assuming noise reduction needs only to be as good as what a perforated tube muffler can provide, a lighter, less resistive grade of fiber metal can be installed and thus possibly reduce the total weight of the muffler by as much as a few ounces. This weight reduction, by itself, may seem insignificant, but "every little bit helps" in mechanized sport that places high value on a higher power-to-weight ratio.

In other industries or markets requiring noise control, such as highway barriers, building acoustics, or heating, ventilation, and air conditioning (HVAC), these benefits are not as valuable or are simply not applicable. For example, the gain in low-frequency attenuation by replacing a standard filled duct silencer's perforated metal screens with fiber metal would be greatly de-valued by the fiber metal's much higher cost. In other words, it would be far cheaper to make a longer standard sound trap featuring perforated metal. Likewise, weight savings would not warrant the additional cost. It is for these reasons, the invention is specially well-suited to muffle four stroke internal combustion engines on vehicles, and other compact applications such as emergency generators, construction equipment, and so on.

For some applications, it may be desirable to change the cross-sectional shape of the duct and/or the surrounding chamber's outer casing. For instance, it is generally known by noise control engineers that increasing the perimeter-to-area ratio can help increase effective noise attenuation for a given unit of length of silencer. Without decreasing cross-sectional area, this can be achieved with a non-circular shape such as a square or rectangle. For aesthetic reasons, or to provide increased surface area for greater advertising real estate, prior art shows the muffler outer shell or housing often has been made oval in shape instead of round. It should be obvious to those skilled in the art of muffler manufacture that other variations are possible, while retaining the following common features: 1) fiber metal duct and/or occlusive insert member; 2) a surrounding annular chamber, with a solid outer wall and solid endcaps, having one or more layers of acoustically absorptive porous materials inside.

For other applications, it may also be desirable to change the cross-sectional area of the duct and/or the surrounding chamber's outer housing. Prior art demonstrates the use of diffusers, for example. The primary benefit of a diffuser is static regain. Static regain is the recovery of velocity pressure into static pressure, made possible by offering the airflow a passage that gradually expands in cross-sectional area. A properly designed diffuser, with total included angle of about twelve degrees can enable static regain efficiency of as much as 80%. Abrupt expansions of passage cross-sectional area, by contrast, usually lose all velocity pressure (i.e., regain efficiency=0%).

To understand the impact of regain on an exhaust system, it should be recalled that the ICE is moving air and gases like any other blower. To generate more horsepower, one usually attempts to increase airflow capacity through the engine. This allows the engine to burn more fuel, increase cycles of operation, and therefore increase more energy release per unit time (i.e., more power). One way to enable this increase of airflow is to reduce or remove flow resistances from the engine's inlets and exhaust. One the exhaust side, the flow resistances are created by aerodynamic turbulence as flow passes through pipe elbows, twists, and cross-sectional area changes. Added to this list is the discharge of flow into the outdoors: the flow does not simply discharge into a vacuum, it loses energy by pushing against atmospheric pressure. By changing the muffler duct from a cylinder to a diffuser, much less velocity pressure is dumped downstream of the tailpipe discharge. In other words, with all other exhaust components being equal, a diffusing muffler offers a flow path of less resistance than does a cylindrical muffler; thus, the diffuser enables the engine to more flow and consequently increase energy output.

Figure 1B:
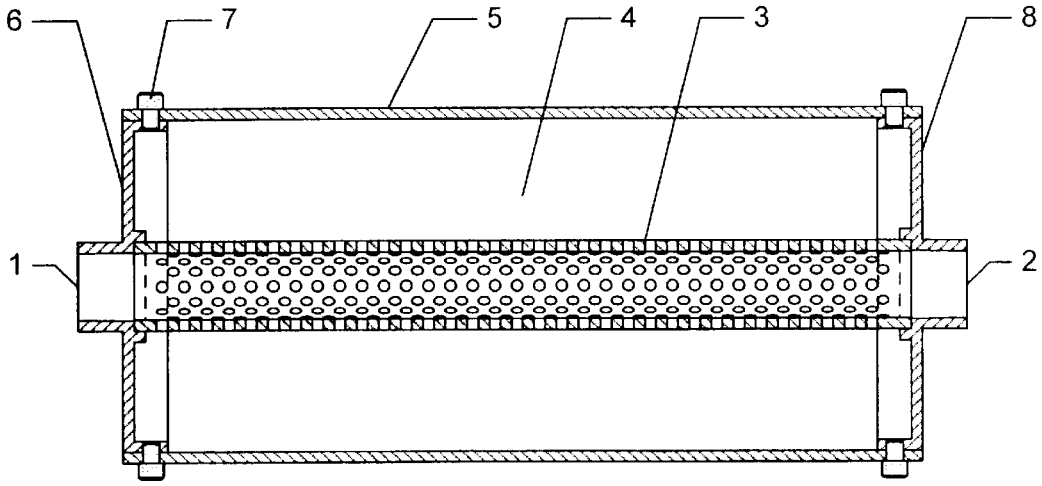
FIG. 1B PRIOR ART
FIG. 1B is a longitudinal sectional view of the device shown in FIG. 1A, showing its internal components.

FIGS. 1B and 1B depict prior art. A typical conventional dissipative muffler is composed of an inlet port (1) fluidically connected to an outlet port (2) by a duct of perforated metal (3) which forms the inner wall of an annular chamber (4), the chamber (4) commonly being filled with one or more layers of acoustically absorbent fill such as fiberglass or steel wool. The outer casing (5) of (4) is solid and is closed on each end by a solid endcap (6, 8). The end caps (6, 8) ordinarily are penetrated by the respective muffler ports (1, 2), and are attached to the casing (5) by some form of mechanical fastener (7).

Figure 2:
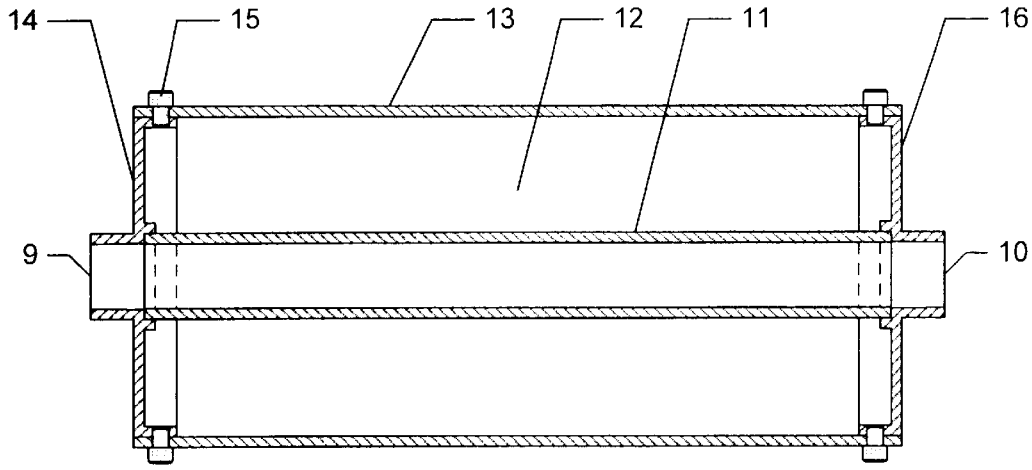
FIG. 2 is a longitudinal sectional view of a dissipative muffler according to one embodiment of the invention, with the perforated duct of the prior art replaced with an alternative type of liner for the surrounding annular chamber.

Turning to the disclosure f the invention, FIG. 2 shows a the muffler design having an overall configuration somewhat similar to that of FIG. 1B, in that it too has an inlet port (9) fluidically connected to an outlet port (10) by a duct (11). The duct (11) forms the inner wall of an annular chamber (12) that is filled with one or more layers of acoustically absorbent fill such as fiberglass. The outer casing (13) surrounding the chamber (12) is solid and is closed on each end by a solid endcap (14, 16). The muffler ports (9, 10) are defined by or penetrate the respective end caps (14, 16). Again, the end caps 14, 16) typically are attached to the casing (13) by some form of mechanical fastener (15). However, it is one object of the invention to provide a duct (11) composed of a highly flow resistive, and highly acoustically transparent material, such as fiber metal. A duct so constructed realizes improvements in low frequency attenuation and backpressure reduction that are practically impossible with prior art materials and methods (e.g., an ordinary metal tube (3), with holes, as seen FIG. 1B).

Figure 3:
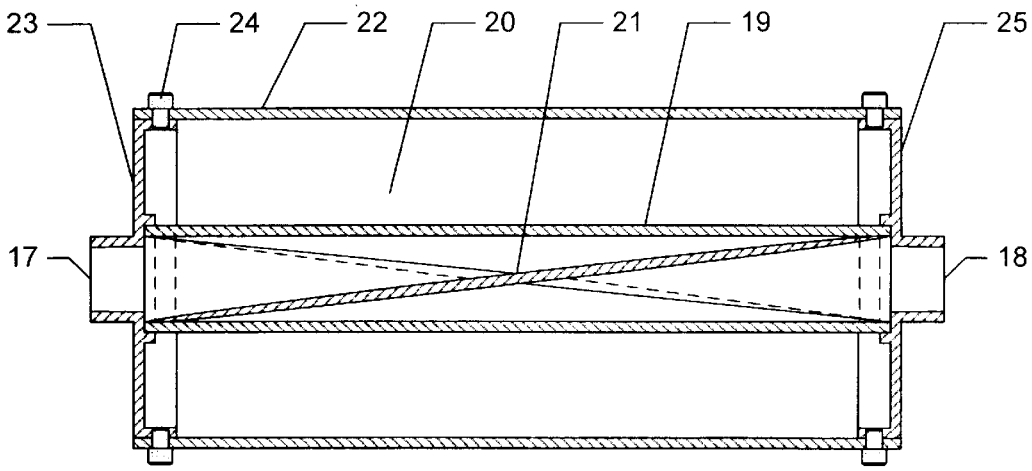
FIG. 3 is a longitudinal sectional view of the embodiment seen in FIG. 2, showing the addition of a helical shaped member inserted into the duct, which provides linear occlusion between the inlet port and the outlet port.

FIG. 3 depicts and embodiment of the invention also having an inlet port (17) fluidically connected to an outlet port (18) by a fiber metal duct (19), the duct (19) forming the inner wall of an annular chamber (20) filled with one or more layers of acoustically absorbent fill such as fiberglass. The outer casing (22) of (20) is solid and is closed on each end by a solid endcap (23, 25). The end caps (23, 25) have muffler ports (17, 18) respectively, and are attached to the casing (22) by some form of mechanical fastener (24). In this embodiment of the invention, the duct (19) surrounds a helical insert (21) composed of a highly flow resistive and highly acoustically transparent material, such as fiber metal. This configuration of the invention achieves improvements in noise attenuation that are impossible with prior art materials and methods relying on linear occlusion.

Figure 4:
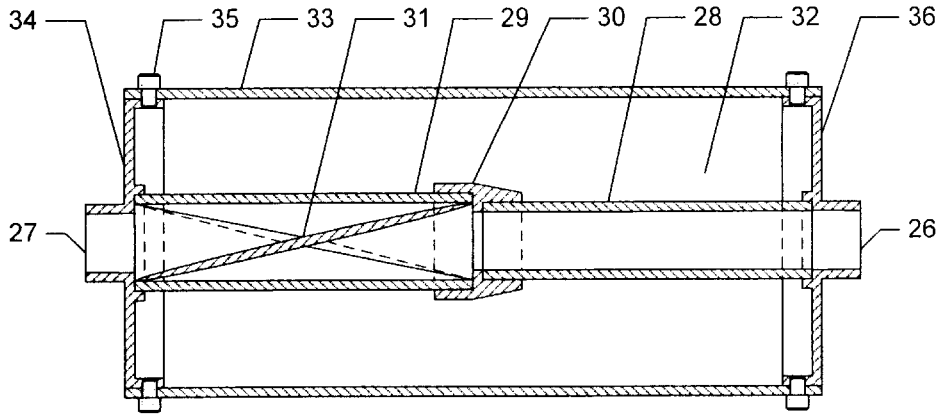
FIG. 4 is a longitudinal sectional view of an alternative embodiment of the invention similar to the embodiment of FIG. 3, illustrating that the helical insert member, or other form of linear occlusion, need not extend the entire distance between the inlet and outlet ports.

Attention is invited to FIG. 4, showing still another embodiment of the present invention. Inlet port (26) is in fluid connection with an outlet port (27) by two fiber metal ducts (28, 29) joined in series by a connector sleeve or collar (30). The ducts (28, 29) and collar (30) together form the inner wall of an annular chamber (32) filled with one or more layers of acoustically absorbent fill such as fiberglass. The outer casing (33) of (32) is solid and is closed on each end by solid endcaps (34, 36). Again, the end caps have muffler ports (26, 27) respectively. The end caps (34, 36) are attached to the casing (33) by some form of mechanical fastener (35). As in FIG. 3, a helical insert (31) of fiber metal or similar high flow resistance and high acoustic transparency material provides linear occlusion without having to contact both muffler ports (26, 27).

Figure 5:
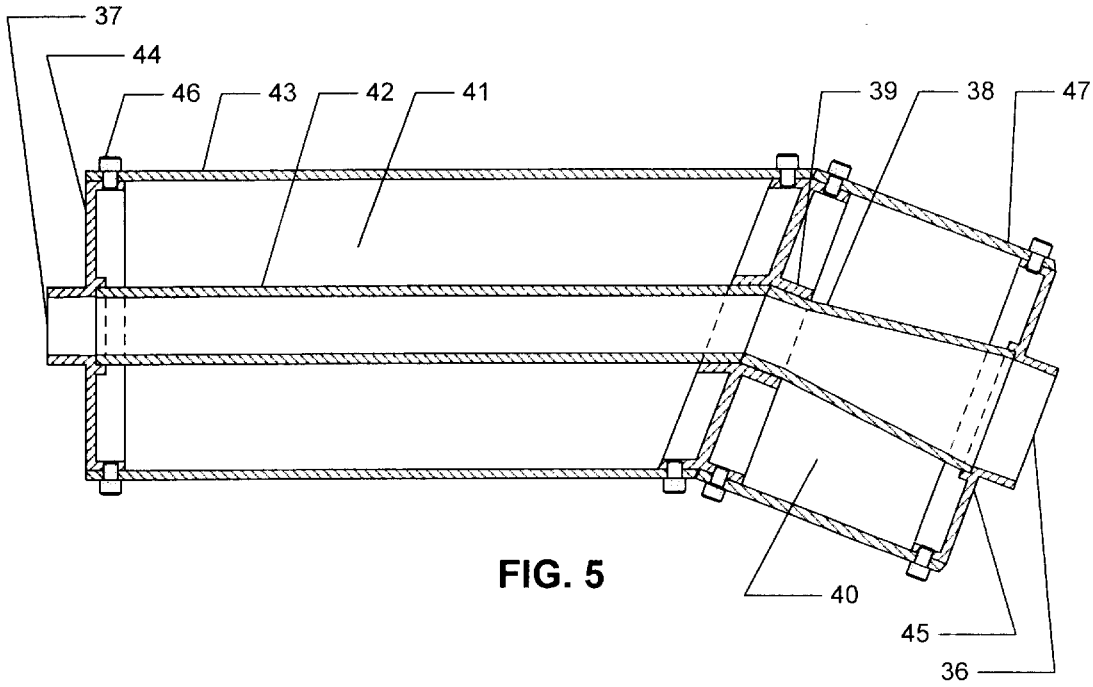
FIG. 5 is a longitudinal sectional view of yet another embodiment of the invention, depicting linear occlusion by an elbow.

FIG. 5 illustrates yet another embodiment of the present invention. This alternative embodiment features an elbow flow passage as a method of providing linear occlusion. An inlet port (36) is fluidically connected to an outlet port (37) by a fiber metal duct (42) and a fiber metal cone (38) joined in series by a connector sleeve or collar (39). As shown, (39) effectively creates two chambers (40, 41) filled with one or more layers of acoustically absorbent fill such as fiberglass. Due to the design of the collar (39), the solid outer casing has two pieces (43, 47). Mechanical fasteners (46) allow disassembly of the muffler for installation or replacement of acoustical media that fills the chambers (40, 41). Solid endcaps (44, 45) are also attached via (46), and each provide the muffler ports (36, 37) respectively. Other embodiments of (39) might be configured such that chambers (40, 41) actually define a single media-filled chamber, which is not expected to significantly alter muffler performance.

Figure 6:
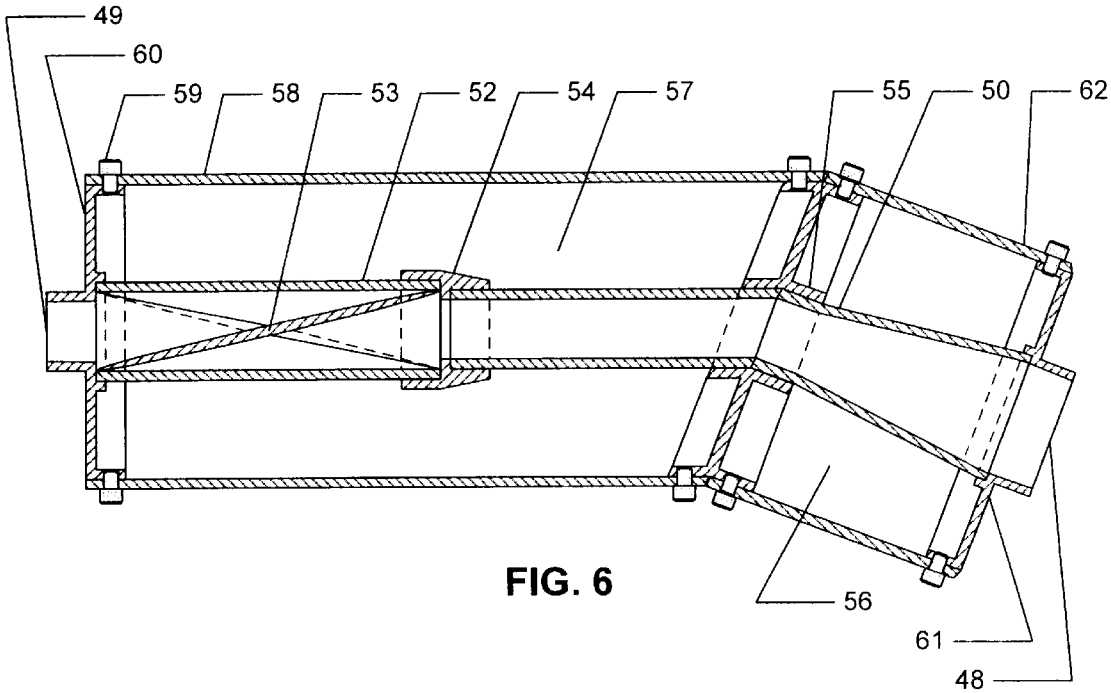
FIG. 6 is another alternative embodiment of the invention, where an embodiment similar to that seen in FIG. 5 is provided with a helical insert for still more linear occlusion.

FIG. 6 is an embodiment of the invention combining features from the embodiments seen in FIG. 4 and FIG. 5, providing an elbow flow passage as a method of providing linear occlusion. An inlet port (48) is fluidically connected to an outlet port (49) by two fiber metal ducts (51, 52) and a fiber metal cone (50), all joined in series by two connector sleeves (54, 55). As shown, (55) separates two chambers (56, 57), one or both of which are filled with one or more layers of acoustically absorbent fill such as fiberglass. Due to the design of the posterior sleeve (55), the solid outer casing is also separated into two pieces (58, 62). Mechanical fasteners (59) allow disassembly of the muffler for installation or replacement of acoustical media that fills the chambers (56, 57). Solid endcaps (60, 61) are also attached via fasteners (59), and each endcap defines and is penetrated by the muffler ports (48, 49) respectively. Other embodiments of the sleeve (55) might be configured such that chamber (56, 57) are actually a single contiguous chamber, which is not expected to significantly alter muffler performance. As with the embodiment seen in FIG. 4, the embodiment of FIG. 6 does not require a helical insert (53) to stretch the entire distance between the ports (48, 49). While the additional linear occlusion provided by a helical shaped insert (53) may seem superfluous in a muffler that already has a line-of-sight (LOS) blocking, testing by the inventors demonstrates that the increase in noise attenuation is significant while increased pressure drop seemed negligible.

Figure 7:
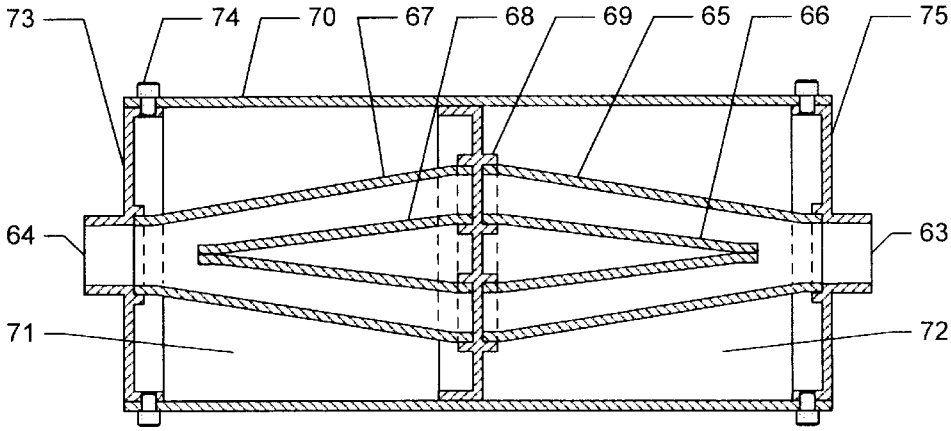
FIG. 7 is a longitudinal section of an alternative embodiment of the invention, whereby conveyed gas flow is diverted around a coaxially located body which, by consequence of its shape and position, affords yet another form of linear occlusion.

FIG. 7 illustrates yet another embodiment using linear occlusion, whereby an inlet port (63) is fluidically connected to an outlet port (64) by two fiber metal cones (65, 67). The cones (65, 67) are joined in series by a connector sleeve or mounting collar (69). Collar (69) is designed to provide support for outer cones (65, 67) and inner cones (66, 68), yet has axial ports therein to permit passage of gas therethrough. As shown, the collar (69) divides the acoustic media-filled chamber into two regions (71, 72). While this embodiment has a single solid outer casing (70), a modified collar (69) would enable the muffler to be composed of two separable sections, which would allow installation and/or replacement of acoustical media. Solid endcaps (73, 75) are attached via mechanical fasteners (74), and each has one of the muffler ports (63, 64) respectively. Linear occlusion is achieved via two smaller fiber metal cones (66, 68), which are supported by the collar (69). Such a linearly occluding embodiment may be more practical for larger flow volume applications, which might require larger port (63, 64) diameters; embodiments such as that depicted in FIG. 6 that feature a helical insert (53) are less practical for large gas flow volumes. FIG. 7 could also depict a vertical section of an alternative design of a rectangular muffler, whereby (65, 66, 67, 68) would be planar elements (inclined somewhat from the horizontal) instead of cones and still provide linear occlusion.

Figure 8:
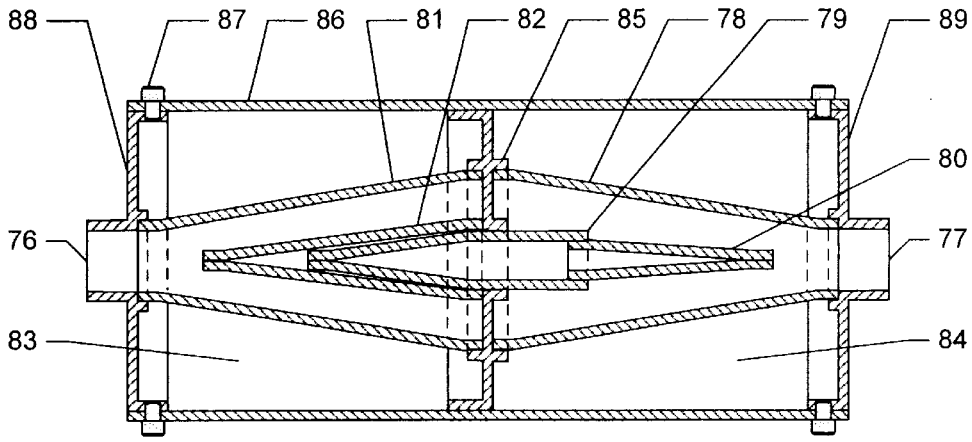
FIG. 8 is a longitudinal sectional view of an alternative embodiment similar to the embodiment of FIG. 7, modified by adding more material in the centrally disposed body.

FIG. 8 shows a variation on the embodiment of FIG. 7, featuring a method to create a centrally disposed body with the same enclosed volume but larger amount of high flow resistance and high acoustic transparency material such as fiber metal. An inlet port (76) is fluidically connected to an outlet port (77) by two fiber metal cones (78, 81) joined in series by a connector sleeve or mounting collar (85). As shown, the collar (85) divides the acoustic media filled chamber into two regions (83, 84). While the embodiment depicted has a single solid outer casing (86), as with the embodiments described above, a person of ordinary skill in the art will note that a modified collar (85) enables the muffler to be composed of two separable sections to allow replacement of acoustical media. Solid endcaps (88, 89) are attached via mechanical fasteners (87), and each provided with the muffler ports (76, 77) respectively. Linear occlusion is achieved via three co-axially nested fiber metal cones (82, 79, 80) supported by the collar (85). As with the embodiment seen in FIG. 7, such a linearly occluding embodiment may be more practical for larger flow volume applications, which might require larger port (76, 77) diameters, as compared to the embodiment of FIG. 6 that features a helical insert (53). The use of three fiber metal cones (82, 79, 80) instead of only two (66, 68) as shown in FIG. 7 permits higher flow resistance resulting from the multiple layers of material.

Such higher flow resistance may be important for certain engine applications. Like FIG. 7, FIG. 8 could alternatively suggests the possibility of a rectangular muffler, whereby (78, 79, 80, 81, 82) are planar elements instead of cones and still provide linear occlusion.

Figure 9:
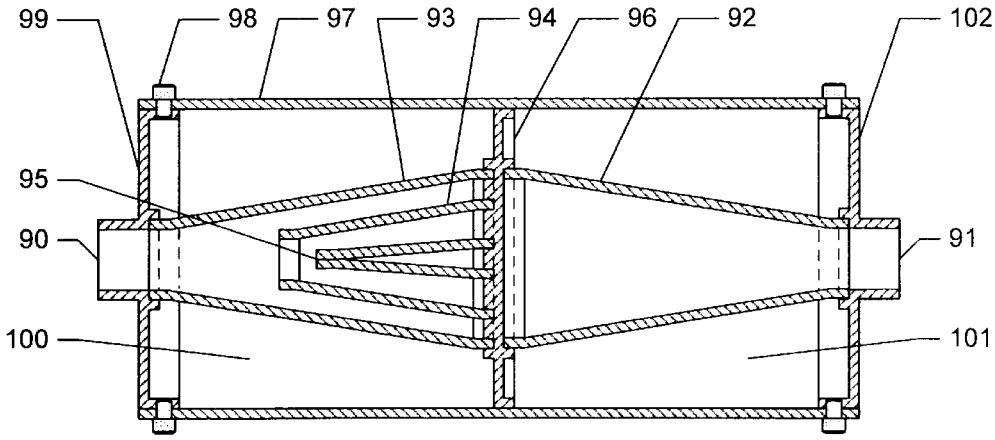
FIG. 9 is a longitudinal sectional view of another embodiment of the invention that incorporates concentric cones to form annular flow passages that provide linear occlusion between inlet and outlet ports.

The embodiment of FIG. 9 utilizes concentric fiber metal cones (94, 95) to achieve linear occlusion, which are supported by a mounting collar (96) with integral spokes. In many other respects, the embodiment of FIG. 9 is very similar to those of FIGS. 7 and 8, with a muffler featuring an inlet port (90) fluidically connected to an outlet port (91) by two fiber metal cones (92, 93) joined in series by the connector sleeve or mounting collar (96). As shown, the collar (96) divides the acoustic media filled chamber into two regions (100, 101). And while this particular muffler design has a single solid outer casing (97), a different form of collar (96) enables the muffler to be composed of two sections temporarily separable for maintenance of absorbent media. Again, solid endcaps (99, 102) are attached via mechanical fasteners (98), and each provides one of the muffler ports (90, 91) respectively. This embodiment provides linear occlusion, but also furnishes a large discharge duct diameter that contracts as flow is conveyed towards the outlet port (91). Such a configuration might accommodate a spark arrestor, particulate filter, or some other insert that would fit into the space afforded by the large entry diameter of the fiber metal nozzle (92). And again, FIG. 9 alternatively may depict a section of a rectangular muffler, whereby (92, 93, 94, 95) would be planar elements instead of cones and still provide linear occlusion.

Operation—Preferred Embodiments

FIGS. 2 through 9 illustrate embodiments of the invention demonstrating the incorporation of vital components composed of fiber metal or similarly flow resistive and acoustically transparent materials. The inventive use of fiber metal components, which act as either liners for traditional acoustically absorbent fill (e.g., fiberglass packing and/or steel wool), or means for low backpressure linear occlusion, or both, enable acoustic improvement not possible with understood prior art. The fill liner function contradicts conventional wisdom and industry teachings for dissipative mufflers, which says prior art materials and methods such as perforated metal must always allow some exhaust gas to flow into the media-filled chamber carrying sound energy: "More holes gives the exhaust gas a greater opportunity to vent into the fiberglass-packed muffler body." (Cook, "The Real World," *Motorcyclist*, December 2000).

On the contrary, we have determined that to be most effective as the core of a low backpressure producing (and thus more energy efficient) and broad-band dissipative muffler, a fill liner must simultaneously act as:

1. A smooth and impermeable barrier to exhaust gas flow, to minimize flow convection, turbulence, and hence unwanted pressure drop; and
2. A virtually transparent window to sound waves, which allows the acoustically absorbent fill to perform as close to its theoretical limits as physically possible, which thereby allows higher absorption efficiencies in the low frequency spectrum.

The superiority of fiber metal as a fill liner to achieve these two functions is classified in two ways according to the invention. First, using the aforementioned equations by Schultz, perforated metal has a calculable "transparency index", which affects an "access factor" that, when multiplied by a material's liner-less absorption coefficient, yields the effective lined absorption coefficient for the fill. For instance, the access factor for 10 kHz is (Schultz, p. 36):

$$AF=10^{-(A/10)}, \text{ where } A_{10\ KHz}=-22.56 \log \log(TI)+0.008(TI)^{0.5}+13.79 \text{ dB}$$

For perforated metals, it is known and commonly accepted that the diameter of the perforation cannot be smaller than the material thickness: the mechanical means for making the perforations will likely break if its diameter is smaller than the sheet metal thickness. Thus, as the diameter goes to zero, so must the material thickness-and vice versa. This condition imposes limits not only on the perforation diameter, but on the number of perforations per unit area, the distance between holes, and thus the overall TI. Fiber metals, on the other hand, with their very small but measurable non-perforated pores or openings, do not suffer this limitation. Hence, TI for the claimed set of felt liners is much higher than any practical perforated metal, if one assumes a "perforation" in Schultz's equation can also mean simply an "opening" or "pore" of some other foraminous material. This assumption allows one to similarly calculate TI for other materials, such as wire mesh and screens, and have a basis for comparison.

Second, because of the said diameter-to-thickness limitation, there is also a threshold on the flow resistance of perforated metal, as previously defined by Schultz. Again, fiber metals and fine wire meshes are not so constrained and can therefore demonstrate much higher flow resistances-often several orders of magnitude higher. Standardized tests for determining flow resistance of a material are known in the art, and could be used to compare dissimilar foraminous materials such as perforated metal, wire mesh, fiber metal and others.

The advantage of such enormous increase in flow resistance is twofold:

(1) At low frequencies, such as 63 Hertz (Hz), for a rigid fill liner, normalized flow resistance approaching a value of 2.0 enables twice the sound absorption per unit length of dissipative muffler than that of a liner with near-zero normalized flow resistance. (Ingard, *Sound Absorption Technology*, p. 4–25)

(2) Greater flow resistance reduces diverted flow, which reduces unwanted backpressure. For instance, when used as a facing for empty cavities, grazing flow over a fiber metal surface causes very small but measurable pressure losses (Hersh and Walker, NASA CR-2951, p. 19).

Most dissipative mufflers feature a duct which is surrounded, about its central axis, by a larger annular chamber. If this duct were completely solid, the conveyed gas flow wouldn't encounter the surrounding chamber at all, and any pressure drop would depend only on the frictional loss caused by the impermeable liner and the velocity pressure of the conveyed flow. Of course, an impermeable liner would also be a mostly reflective barrier to sound waves, resulting in little if any attenuation. On the other hand, if the duct was absent, or was composed of a material that had no flow resistance, sound waves and conveyed gas flow could freely and travel through it and into the acoustically absorbing media. While good for sound absorption, the unhindered diffusion of gas flow from the duct into the larger surrounding chamber results in energy-losing turbulence that might, in some cases, create more noise than the muffler is designed to attenuate!

Prior art suggests that fill liners, like perforated metals, are therefore chosen somewhere between the extremes of impermeability and complete permeability. Such a compromise, demonstrated by the nearly ubiquitous and decades-long use of "perforated and packing" for dissipative mufflers (especially in the world of ICE applications), and reinforced by teachings in the art (e.g., Cook), is erroneous and no longer required. A set of fill liners does exist that effectively provides what conventional wisdom argued is a contradictory phenomenon: a barrier to flow and a portal to sound. This said set should have the following characteristics to be considered operationally and economically optimum: The "normalized flow resistance", or ratio of liner flow resistance over the acoustic impedance of the conveyed gas flow, should result in a dimensionless quantity that falls between approximately 0.2 and approximately 2.0. Crafting an apparatus to satisfy the limits of this ratio is central to the invention, and is accomplished by integrating into the apparatus elements fashioned form metal fiber.

While aforementioned prior art by Clark claims various ranges of fiber metal and other material flow resistance (a.k.a., "impedance"), Ingard correctly identifies normalized flow resistance as the acoustically important parameter. In this manner, the choice of material for the liner and properties of the gas flow specific to the application may vary so long as the ratio of the former over the latter results in a dimensionless quantity that falls in the acoustical performance range of interest.

Ingard's curves (Ingard, *Sound Absorption Technology*, p. 4–25) depict the approximate possible bounds of such a range. As exhibited by Ingard, a ratio near-zero normalized flow resistance will not demonstrate the desired improvement in low frequency sound attenuation, and values much higher than 2 will result in improvements of absorption coefficient for lower and lower frequencies at the expense of dramatically reduced absorption coefficient in the mid and high-frequency spectrum. Using Schultz's aforementioned formula to calculate flow resistance for a variety of commercially available perforated metals and other conventional liner materials, the inventor determined a ratio value of 0.2 sufficiently exceeds what is currently exhibited by most prior art fill liners. Exceptions like filter cloths surpassed the other end of the range, and were likewise not considered beneficial.

The transparency index, as calculated with the Schultz formula, should exceed 100,000.

Such high liner TI, simply put, allows more sound to enter the fill across a wider frequency spectrum. In the low frequency bands, where engine exhaust noise is predominant and a challenge to attenuate, perforated metal and other prior art techniques do not have enough TI to allow the fill to perform up to its full acoustical absorption potential. An investigation of various liner materials by the inventor, using Schultz's TI formula, determined the prior art does not achieve the above specified value.

Previous attempts to improve the flow resistance of a liner, such as fiberglass cloth bonded to perforated metal, would similarly be excluded as the overall acoustic transparency would depend on the material layer having the least transparency. In this example, the perforated metal likely has the TI value that is far less than 100,000.

The liner should be rigid.

Obviously, in exhaust applications where gas flow temperatures and pressures are high, mufflers need to be ruggedly constructed of sufficiently stiff or self-supporting components. A non-rigid liner, such as one that expands radially with flow pressure, may not be desirable because the corresponding duct diameter would increase and hence create the turbulence-generating flow geometry of an expansion chamber. A rigid liner, on the other hand, maintains its shape under pressure and allows more efficient flow. The liner rigidity requirement is also acoustically important, and disqualifies prior art such as unsupported fiberglass cloth, because Ingard also illustrates that low frequency performance generally improves as the liner is made less flexible (*Sound Absorption Technology*, p. 4–26).

Thus, a dissipative muffler with a liner satisfying all the three foregoing criteria should demonstrate better low frequency attenuation when compared with a perforated metal liner having the same duct diameter and length. Results of prototype testing of the invention confirm. As described, FIGS. 2 through 9 use one or more elements manufactured from fiber metal as a physical boundary between the conveyed gas flow and the surrounding volume of traditional acoustically absorbent media. Thus, the present invention harnesses the advantages of dissipative mufflers while ameliorating or eliminating their principal disadvantages.

Additional prototype testing has demonstrated that fiber metal, or some similar high flow resistance and highly acoustically transparent material, can be used to provide linear occlusion and thus offer additional attenuation means as shown in FIGS. 3, 4, 6, 7, 8, and 9. Whether the linear occlusion is provided by a helical insert, as illustrated in FIGS. 3, 4, and 6, or by way of a centrally disposed body positioned coaxially with the muffler's inlet and outlet ports (see FIGS. 7, 8, and 9), or by merely providing an elbow or turn in the flow passage as in FIGS. 5 and 6, or by some other means or combination that should be obvious to one skilled in the art of muffler manufacture and design, linear occlusion by fiber metal elements enables the following:

Blockage of line-of-sight (LOS) with minimal backpressure. LOS is a known term used to describe a geometrical condition whereby high-frequency sound can beam directly from one port of a tube or duct to the opposite port without encountering any obstruction. This occurs when the sound wavelength is less than the diameter of the flow-conveying duct. Blocking LOS, therefore, means high frequency noise is deflected by an obstruction and will likely encounter an acoustically absorptive surface and/or volume inside the muffler surrounding the said tube or duct; and Fundamental and higher mode attenuation. In the same manner that fiber metal, when sufficiently spaced from a wall, can enable dissipative attenuation on its own (i.e., without neighboring fill) via impedance matching, the insert provides another surface in the gas stream that is virtually invisible to sound-except when a wave's peak amplitude crosses it.

As depicted in FIGS. 3, 4, and 6, such a linearly occluding insert, embodied in a helical form, need only feature a rectangular strip or panel having a one-half twist or revolution (180 degrees) to provide this LOS-blocking benefit. And, as specified for the liner, the insert should be composed of a material that satisfies the same three parameters: A) normalized flow resistance between about 0.2 and about 2.0; B) high transparency; and C) rigidity. In this case, rigidity is obviously important for keeping the insert from deforming or moving in the presence of high temperature and/or high velocity gas flow that might preclude use of, say, unsupported fiberglass cloth (e.g., U.S. Pat. No. 4,211,302 to Mathews) which could still satisfy conditions A. and B.

Notable, were a helical element to be fashioned from ordinary perforated metal, the benefits offered by the invention would not be realized. Further, the lower flow resistance and geometry of the perforated metal would make it a backpressure-producing obstruction. And when such LOS-blocking or linearly occluding inserts have been made from solid materials, fundamental and higher mode attenuation attributed to impedance-matching is also unrealized.

Attachment of a helical insert (e.g. (21) in FIG. 3) to the duct wall is not necessary, but could be implemented to eliminate the use of retaining ridges or lips inside the flow passage as shown on several of the Figures. Other insert embodiments may require spokes, struts, or other means of support to enable contact and/or attachment as necessary. Those skilled in the art of muffler manufacture may be aware of, or could devise, similarly-performing inserts that are not shown. Prior art demonstrates many forms of linear occlusion have been realized, although none appear to use fiber metal.

One advantage of fiber metal used for linear occlusion is it may be used to replace solid surfaces normally required for spark-arresting mufflers. The mean pore size of common fiber metal varieties is much smaller than the 0.023" maximum screen hole size specified by the U.S. Forest Service. While it would probably be too restrictive and hence an unsuitable material choice for a cinder filter screen, fiber metal might be used where solid surfaces are required and enable impedance-matching acoustic absorption that is unattainable with prior art methods of spark arrestment.

For some applications, it may be desirable to combine several exhaust ducts into a fewer number of ducts (or just one) or vice versa: expand one or more ducts into a greater number of branches. In these situations, a muffler could be fabricated to have one inlet port and several outlet ports. Alternately, a muffler could feature several inlet ports and a fewer number (or one) outlet port. Such techniques could utilize fiber metal ducts and duct branches to connect the inlet ports to the outlet ports. Although the invention has been described in detail with particular reference to preferred embodiments, other embodiments can achieve the same results. Variations and modifications of the present invention will be obvious to those skilled in the art and it is intended to cover in the appended claims all such modifications and equivalents.

What is claimed is:

1. A sound attenuating apparatus for conveying internal combustion engine exhaust gases, the gases having an acoustical impedance, the apparatus comprising:

an inlet port and an outlet port;

a rigid duct fluidically connecting said ports, said duct having a flow resistance and defining an inner wall of a chamber; and means for acoustic absorption disposed in said chamber; wherein said duct has a transparency index greater than 100,000 as calculated from Schultz's formula, and further wherein the ratio of the flow resistance of said duct to the acoustic impedance of said exhaust gases is between approximately 0.2 and approximately 2.0.

2. A sound attenuating apparatus according to claim 1 wherein said duct is composed of a single material.

3. A sound attenuating apparatus according to claim 1 wherein said duct is composed of a plurality of materials.

4. A sound attenuating apparatus according to claim 1 wherein said duct provides linear occlusion between said ports.

5. A sound attenuating apparatus for conveying internal combustion engine exhaust gases, the gases having an acoustic impedance, the apparatus comprising:

an inlet port and an outlet port fluidically connected by a rigid duct, said duct defining an inner wall of a chamber filled with means for acoustic absorption; and means for linear occlusion disposed within said duct, said linear occlusion means having a transparency index greater than about 100,000 as calculated from Schultz's formula, and said linear occlusion means also having a flow resistance;

wherein the ratio of the flow resistance of said linear occlusion to the acoustic impedance of said exhaust gases results is between 0.2 and 2.0.

6. A sound attenuating apparatus according to claim 5 wherein said means for linear occlusion comprises a single member.

7. A sound attenuating apparatus according to claim 5 wherein said means for linear occlusion comprises a plurality of members.

8. A sound attenuating apparatus according to claim 5 wherein said means for linear occlusion is removable from said duct.

9. A sound attenuating apparatus according to claim 5 wherein said means for linear occlusion is composed of a single material.

10. A sound attenuating apparatus according to claim 5 wherein said means for linear occlusion is composed of a plurality of materials.

11. A sound attenuating apparatus for conveying internal combustion engine exhaust gases, the gases having acoustical impedance, said apparatus comprising:

an inlet port and an outlet port fluidically connected by a rigid duct, said duct having a transparency index greater than 100,000 as calculated from Schultz's formula and also a flow resistance;

a chamber, substantially filled with means for acoustical absorption and having an inner wall defined by said duct;

wherein the ratio of the flow resistance of said rigid duct over the acoustic impedance of said exhaust gases results is between 0.2 and 2.0; and means for linear occlusion disposed within said duct, said linear occlusion means having a transparency index greater than 100,000 as calculated from Schultz's formula and also a flow resistance;

wherein the ratio of the flow resistance of said linear occlusion over the acoustic impedance of said exhaust gases is between 0.2 and 2.0.

12. A sound attenuating apparatus according to claim 11 wherein said means for linear occlusion comprises a single member.

13. A sound attenuating apparatus according to claim 11 wherein said means for linear occlusion comprises a conical member.

14. A sound attenuating apparatus according to claim 11 wherein said means for linear occlusion comprises a helical member.

15. A sound attenuating apparatus according to claim 11 wherein said means for linear occlusion is removable from within said duct.

16. A sound attenuating apparatus according to claim 11 wherein said means for linear occlusion comprises a single material.

17. A sound attenuating apparatus according to claim 16 wherein said means for linear occlusion comprises metal fiber.

18. A sound attenuating apparatus according to claim 11 wherein said duct comprises a single material.

19. A sound attenuating apparatus according to claim 11 wherein said duct comprises metal fiber.

20. A sound attenuating apparatus according to claim 11 wherein said duct comprises a plurality of materials.

21. A sound attenuating apparatus according to claim 11 wherein said duct provides linear occlusion between said inlet and outlet ports.

22. A sound attenuating apparatus for conveying internal combustion engine exhaust gases, the gases having an acoustic impedance, the apparatus comprising:

an inlet port and an outlet port fluidically connected by a rigid duct, said duct defining an inner wall of a chamber filled with means for acoustic absorption; and a helical member disposed within said duct, said member having a transparency index greater than about 100,000 as calculated from Schultz's formula, and said helical member also having a flow resistance;

wherein the ratio of the flow resistance of said helical member to the acoustic impedance of said exhaust gases results is between approximately 0.2 and approximately 2.0.

* * * * *